United States Patent [19]

Tegtmeyer et al.

[11] Patent Number: 4,901,636

[45] Date of Patent: Feb. 20, 1990

[54] SPINDLE PRESS

[75] Inventors: Kurt Tegtmeyer, Salzgitter; Hermann Lührs, Grevenbroich; Wolfgang Werner, Braunschweig, all of Fed. Rep. of Germany

[73] Assignee: Salzgitter Maschinenbau GmbH, Salzgitter, Fed. Rep. of Germany

[21] Appl. No.: 252,271

[22] PCT Filed: Nov. 4, 1987

[86] PCT No.: PCT/EP87/00670

§ 371 Date: Jul. 25, 1988

§ 102(e) Date: Jul. 25, 1988

[87] PCT Pub. No.: WO88/04232

PCT Pub. Date: Jun. 16, 1988

[30] Foreign Application Priority Data

Dec. 3, 1986 [DE] Fed. Rep. of Germany ..... 3641248

[51] Int. Cl.[4] ..... B30B 9/12

[52] U.S. Cl. ..... 100/117; 100/150

[58] Field of Search ..... 100/93 S, 104, 110, 100/117, 144–150, 37

[56] References Cited

U.S. PATENT DOCUMENTS

| | | | |
|---|---|---|---|
| 1,354,528 | 10/1920 | Wertenbruch | 100/117 X |
| 2,664,814 | 1/1954 | Ahlborn | 100/117 |
| 2,709,957 | 6/1955 | Armstrong | 100/117 |
| 2,747,499 | 5/1956 | Beeman | 100/147 |
| 2,775,191 | 12/1956 | Youd | 100/117 X |
| 3,426,677 | 2/1969 | Combs . | |
| 3,478,679 | 11/1969 | Bauserman | 100/117 |
| 3,998,148 | 12/1976 | Mainka et al. | 100/117 |

FOREIGN PATENT DOCUMENTS

| | | | |
|---|---|---|---|
| 65165 | 2/1892 | Fed. Rep. of Germany | 100/117 |
| 95086 | 11/1897 | Fed. Rep. of Germany . | |
| 2160585 | 6/1973 | Fed. Rep. of Germany | 100/117 |
| 2641597 | 3/1978 | Fed. Rep. of Germany | 100/150 |
| 2255168 | 7/1975 | France . | |

*Primary Examiner*—Philip R. Coe
*Assistant Examiner*—Stephen F. Gerrity
*Attorney, Agent, or Firm*—Michael J. Striker

[57] ABSTRACT

A spindle press comprises a housing with a circular cylindrical upper part and a lower part. A press spindle, which is drivable in a rotating manner via a drive pipe by a drive arrangement, is supported in an upper bearing and a lower bearing of the housing so as to be rotatable. A spindle body of the press spindle carries worm wings on the outside and compressor blades farther above, which all extend in the vicinity of a screen casing of the upper part. The screen casing is enclosed at a distance by a spray casing and provided with holes for pressed out fluid only from the compressor blades down. The spindle body also comprises perforations for the pressed out fluid only from the compressor blades down. Above the compressor blades a helically constructed front wall is welded in between an annular wall and the screen casing which is unperforated at that point. On the lower side of the front wall, wet pulp arrives tangentially through a filling opponent of the upper part.

18 Claims, 7 Drawing Sheets

FIG. 2
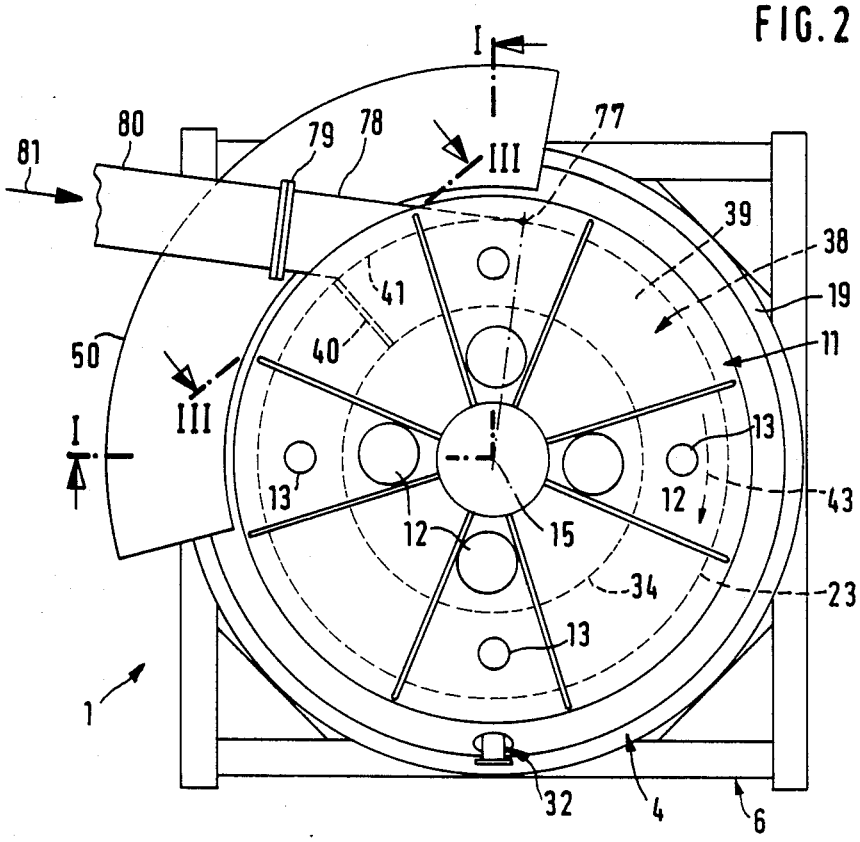
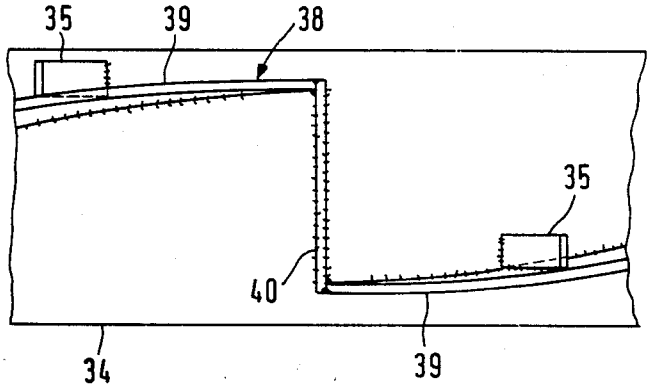
FIG. 3

FIG. 7
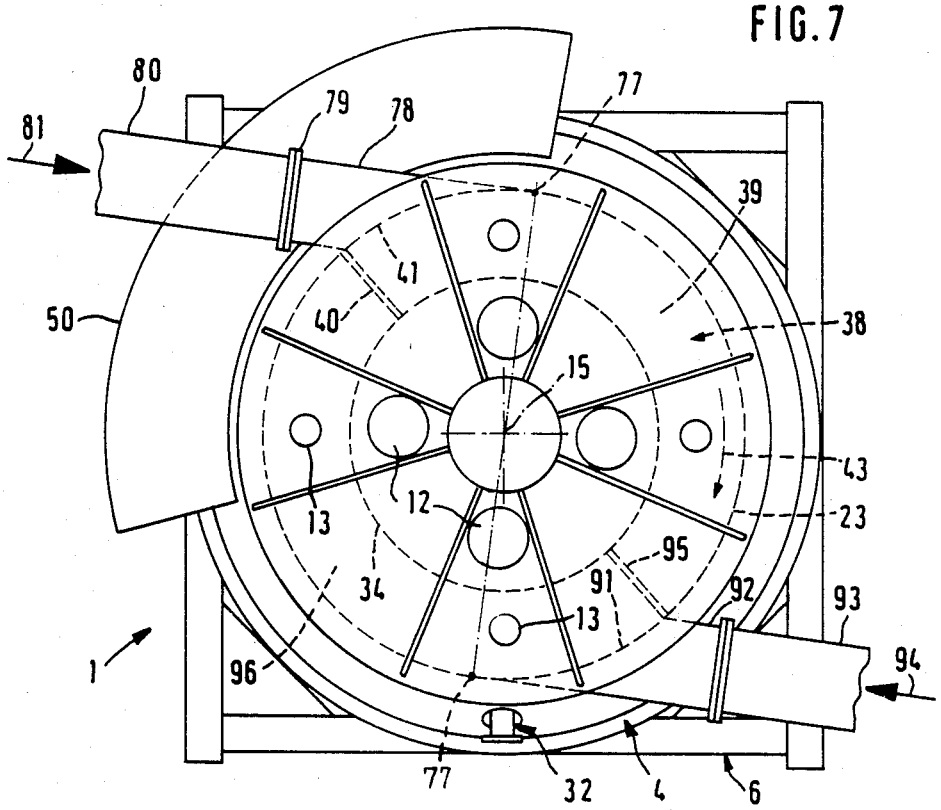
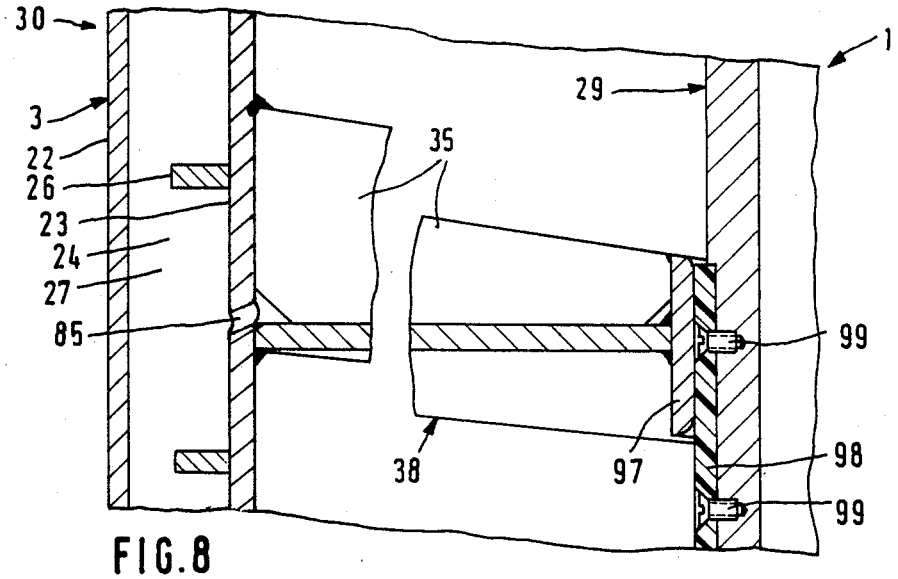
FIG. 8

SPINDLE PRESS

DESCRIPTION

The invention is directed to a spindle press. More particularly it relates to a spindle press for pressing fluid out of a material, such as sugar beet pulp, which has a housing including a spray casing and a screen casing defining a first annular space therebetween for guiding out fluid, a press spindle rotatable in said housing and having an interior space for guiding out fluid and perforations for fluid, wherein a second annular space is formed between the housing and the spindle for feeding the material to be pressed into and for discharging the pressed material from it.

In a known spindle press of this type (DE-OS 23 64 292) constructed as a pulp press, the housing is constructed in three parts from an upper part, a central part and a lower part. A drive housing is placed on the upper part. The press spindle is supported at the bottom in a central pivot bearing and at the top in a combined radial and axial bearing of the drive housing having a large diameter. The wet pulp is introduced into the upper part radially at the circumference by means of upwardly extending filling shafts, the upper part comprising interruptors; at this upper part, a circular cylindrical upper continuation of the spindle body carries worm wings for precompressing the wet pulp. At the top, the upper part comprises a front wall which extends in a horizontal plane and is sealed with a gland relative to the upper continuation of the press spindle. The overall height and the expenditure in terms of construction of this pulp press are relatively high. The drive housing, including the drives, and the upper part load the central and lower part of the housing. The relatively large axial length of the upper part and the interruptors and worm wings of the upper continuation of the spindle body acting in the upper part do not provide a sufficient precompression of the wet pulp, in spite of the expenditure involved.

SUMMARY OF THE INVENTION

The invention has the object of increasing the precompression of the material to be pressed in the head of the spindle press with little construction related expenditure.

In keeping with these objects and with others which will become apparant hereinafter, one feature of the present invention resides, briefly stated, in that a front wall which extends transversely to the longitudinal axis of the spindle press is constructed so as to be helical in an opposite manner relative to the configuration of the worm wings, and so that the commencement of the worm wings lies behind an outlet side and of the front wall.

The longitudinal axis of the spindle press can extend vertically (upright) or horizontally (lying) or can occupy any intermediate position. In a circular cylindrical housing, the cross-sectional surface area of the spindle body preferably increases from the feed side to the outlet side. The pitch of the worm wings on the spindle body likewise preferably decreases from the feed side to the outlet side. As a rule, interruptors are fastened at the housing between adjacent worm wings so as to be distributed in a transverse plane and extend until the vicinity of the spindle body. The front wall can be welded, e.g. with the screen wall on the outside. A considerable precompression of the material to be pressed results because of the screwlike construction of the front wall as soon as the material has filled the entire second annular space between the screen casing and the spindle body after the spindle press is started. After this considerable precompression, it is easier to achieve the desired amount of dry substance of the pressed material in the remainder of the second annular space until the outlet annular gap.

In accordance with another feature of the present invention, a screw part of the front wall extends from an axial end of each filling opening on the feed side to an axial end of the same on the outlet side in direction of rotation or an axial of filling opening on the outlet side which filling opening is adjacent in direction of rotation of the press spindle. A commencement of each screw part of the feed side is connected in a tight manner with an end of the same on the outlet side or with the end of a screw part on the outlet side which screw part is adjacent in direction of rotation. The connection is performed by a connection part which is sealed on an inside relative to the spindle body and is connected in a tight manner on the outside of the housing.

The screw and connection parts can be produced from sheet metal and welded with one another and with the screen casing of the housing. The internal sealing of the screw and connection parts relative to the spindle body can be effected directly or indirectly. This sealing prevents material to be pressed and fluid from penetrating to the end of the spindle body on the feed side in an undesired manner. Every connection part prevents material to be pressed and fluid from reaching the surface of the screw parts on the feed side.

Every screw part and every connection part can be connected in a tight manner on the outside with the screen casing of the housing.

According to these features a particularly small overall height of the spindle press results because the upper part, according to DE-OS 23 64 292, is economized on. The tight connection can be produced, e.g. by means of welding.

The screen casing can be formed so that it does not comprise any holes for the passage of pressed out fluid, at least in an axial area located opposite to the front wall. These features prevent fluid from being pressed out prematurely and prevent a pressure drop, which is connected with it, from taking place in the material to be pressed.

The screen casing can be provided with dewatering holes on the feed side of the front wall for condensation, which dewatering holes can open into the first annular space. With these features the space on the feed side of the front wall is dewatered in a simple manner.

The sealing of the annular wall relative to the spindle body is achieved in a particularly simple and operationally reliable manner. When the front wall is fastened on an inside at an annular wall so as to be tied, and the annular wall encloses an end of the spindle body on the feed side and is sealed relative to the spindle body on the outlet side, for example by means of an annular seal. The annular wall is preferably constructed in a circular cylindrical manner. The annular wall can be provided with a sliding surface of stainless steel on the inside, for example. A sliding seal, which consists of the plastics material known under the trademark Teflon, slides on this sliding surface. In this way, an indirect sealing of the front wall is effected relative to the spindle body.

However, a direct sealing is also possible in this area when the front wall is sealed on an inside directly relative to the spindle body.

In addition, one may proceed with the construction in which the front wall has a helical sliding ring on an inside, and the sliding ring contacts a gasket on a portion of the spindle body on the feed side so as to seal, with the gasket being cylindrical at least on an outside.

The sliding ring also extends along the connection parts and consists, e.g. of stainless steel. The sealing sleeve or gasket can consist, e.g. of the plastics material known under the trademark Teflon.

The gasket and the portion of the spindle body on the feed side can be circular cylindrical. These steps are particularly simple with respect to manufacturing technology.

The front wall can carry a helical sealing slip on an inside, and the sealing strip can contact a circular cylindrical outer surface of the spindle body so as to form a seal. These also extends along the connection parts and consists, e.g. of the plastics material known under the trademark Teflon.

The spindle body can carry compressor blades in at least one transverse plane adjacent to the end of the front wall on the feed side and prior to the commencement of the worm wings. The compressor blades can extend outwardly at least approximately in contact with said screen casing. These features provide for additional precompression of the material to be pressed is achieved in the head of the spindle press.

A premature pressing out of fluid is also prevented at the spindle body. When the spindle body is provided with perforations for passage of pressed out fluid only after the outlet side end of the front wall in direction of the outlet side.

The hole in the screen casing and the perforations in the spindle body can begin in the area of the compressor blades. With such a construction the commencement of the release of pressed out fluid has proven particularly advisable.

The filling arrangement can comprise at least one tamping worm. In this case an increased pressure of the material to be pressed is already effected in the filling opening. By means of this "overfilling" of the second annular space in the head of the spindle press, a small overall height is achieved on the one hand and favorable preconditions for achieving a particularly high amount of dry substance is provided on the other hand at the outlet annular gap of the second annular space.

When every tamping worm is connected to the respective filling opening tangentially relative to the second annular space the wet pulp is fed into the second annular space in a manner which is particularly favorable in terms of flow.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 shows a top view of the spindle press according to line II—II in FIG. 1, FIG. 3 shows a view, according to line III—III in FIG. 2, of a portion of the spindle press without screen casing, in an enlarged view, FIG. 7 shows a top view, corresponding to FIG. 2, of another embodiment form of the spindle press with two filling openings, FIG. 8 shows a partial longitudinal section through the head of another spindle press and FIG. 9 shows a partial longitudinal section through the head of another spindle press.

DESCRIPTION OF THE PREFERRED EMBODIMENTS

Figure 1:
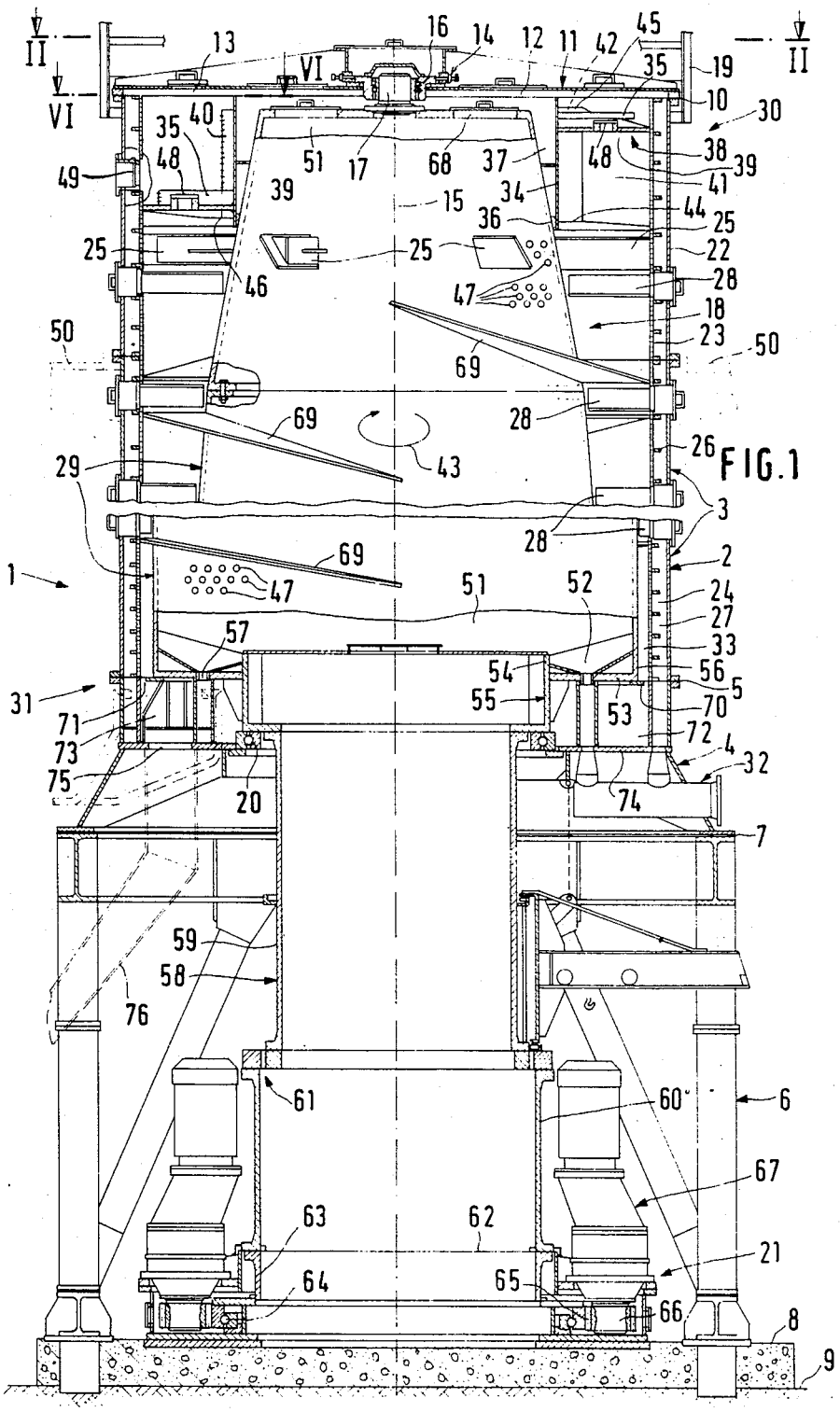
FIG. 1 shows a longitudinal section according to line I—I in FIG. 2 through a vertically arranged spindle press constructed as a pulp press.

In FIG. 1, a spindle press 1, which is constructed as a pulp press, comprises a housing 2 with a circular cylindrical upper part 3 and a lower part 4 which are screwed together along a plane 5. The lower part 4 rests on a vertical frame 6 so as to be fixed with respect to rotation and is screwed with this along a plane 7. The vertical frame 6 is fastened at a foundation 8 which rests on a base 9.

A cover 11, in which manholes 12 and observation openings 13 are provided, is screwed with the upper part 3 along a plane 10. The cover 11 carries an upper bearing 16, which is adjustable in the radial direction with respect to a longitudinal axis 15 of the spindle press 1 by means of an adjusting mechanism 14, in which a shaft end 17 of a press spindle 18 is supported so as to be rotatable. The cover 11 is enclosed by a railing 19 fastened at the upper part 3.

The press spindle 18 is rotatably supported at the bottom in a lower bearing 20 of the lower part 4, which lower bearing 20 is constructed as a ball bearing slewing connection, and is drivable so as to rotate by means of a drive arrangement 21 arranged in the vertical frame 6.

The upper part 3 of the housing 2 comprises a spray casing 22, which is divided into axially successive sections, and a screen casing 23 which is arranged within the spray casing 22 and is likewise divided into axially successive sections. A first annular space 24 is provided between the spray casing 22 and the screen wall 23 for guiding out fluid which is pressed out of the sugar beet pulp and passes out through screen holes, not shown in FIG. 1, through the screen casing 23. The screen casing is provided with such screen holes from the compressor blades 25 until the plane 5 (compare FIGS. 4A and 4B). The screen casing 23 is supported on the outside at supporting rings 26 which are arranged at an axial distance from one another and are held in turn by comb-like plates 27 which extend parallel to the axis, are arranged at a distance from one another in the circumferential direction and fastened at an inner surface of the spray casing 22 (compare also FIG. 6). Interruptors 28, which extend radially inward until the vicinity of a spindle body 29 of the press spindle 18, are inserted into receiving openings of the upper part 3 from the outside in a plurality of vertical planes. The radial extension of the interruptors 28 decreases from the top to the bottom in the same way that the cross-sectional surface area of the spindle body 29 increases from an upper feed side 30 of the spindle press 1 to its lower outlet side 31. The first annular space 24 is connected with a dewatering mechanism 32 in the lower part 4.

Between the screen casing 23 and the spindle body 29, there is a second annular space 33, in which an annular wall 34 extends from the top proceeding from the plane 10. The annular wall 34 thus encloses an upper end area of the spindle body 29 and is welded with the screen casing 23 by means of external web plates 35 (see also FIGS. 4A, 4B and 6). An annular seal 36, which prevents material to be pressed and fluid from penetrating upward into a wedgeshaped annular space 37 between the upper end area of the spindle body 29 and the annular wall 34, is provided between the spindle body 29 and the annular wall 34. FIG. 5 shows details of the annular seal 36.

The second annular space 33 is defined at the top by a front wall 38 which is constructed in the manner of a screw and welded on the outside with the screen casing 23 so as to be tight and on the inside with the annular wall 34, also so as to be tight. In the embodiment example, according to FIG. 1, the front wall 38 is composed of a screw part 39 produced from sheet metal and a connection part 40 which likewise consists of sheet metal. The upper part 3 comprises a rectangular filling opening 41 through which wet pulp is fed into the second annular space 33. The screw part 39 extends in a rotating direction 43 of the press spindle 18 from an axial end 42 of the filling opening 41 on the feed side until an axial end 44 of the filling opening 41 on the outlet side. The start 45 of the screw part 39 on the feed side is connected with an end 46 of the screw part 39 on the outlet side by means of the connection part 40 so as to be tight. The connection part 40 is arranged in a plane extending through the longitudinal axis 15.

The screen casing 23 does not comprise any holes for the passage of pressed out fluid in the area between the compressor blades 25 and the front wall 38. The compressor blades 25 are fastened internally at the spindle body 29. The spindle body 29 is also only provided with perforations 47 for the passage of pressed out fluid from the compressor blades 25 downwards.

Observation windows 48 are provided in the screw part 39 which are aligned with the observation openings 13 in the cover 11 in an axial direction. Observation windows 49 are also inserted in the upper part 3, only one of which is drawn in FIG. 1, specifically, so as to be offset in the circumferential direction. The observation windows 49 make it possible to see into the second annular space 33 below the front wall 38 from the side. A work platform 50, which extends along approximately one third of the circumference, is fastened at the outside of the upper part 3 (compare FIG. 2).

The spindle body 29 is hollow and comprises an interior space 51 in which the perforations 47 allow pressed out fluid to pass through. The interior space 51 ends at the bottom in an annular duct 52 which is open at the top. The annular duct 52 is defined by means of an annular base 53 of the spindle body 29, a ring 54 of a central base connection piece 55 of the spindle body 29, which ring 54 extends upward beyond the base 53, and a side wall 56 of the spindle body 29. The base 53 comprises outlet connection pieces 57 arranged on a circle which is concentric with the longitudinal axis 15 of the spindle press 1.

The base connection piece 55 is connected with an inner ring of the lower bearing and with a telescoping drive pipe 58 which extends in the downward direction. An upper pipe 59 and a lower pipe 60 of the drive pipe 58 are connected with one another by means of a tooth coupling 61. The lower pipe 60 is screwed along a plane 62 with a drive connection piece 63 which is rotatably supported in a drive bearing 64. The drive connection piece 63 carries a toothed ring 65 on the outside, with which pinions 66 of stationary drives 67 mesh.

The outlet connection pieces 57 open into the dewatering arrangement 32. Manholes 68 are provided in the spindle body 29 at the top. In addition, the spindle body 29 carries worm wings 69 which extend outward at least approximately in contact with the screen casing 23 and whose slope and axial distance from one another decrease from the feed side 30 to the outlet side 31. A retaining ring 70, which projects outward radially over the side wall 56 and which defines an outlet annular gap 71 for the pressed pulp with the screen casing 23, is screwed on at the lower side of the base 53. After leaving the outlet annular gap 71, the pressed pulp falls into an annular space 72 of the lower part 4, in which clearing wings 73 circulate, the clearing wings 73 being fastened at the lower side of the base 53. Diametrically opposed fall-out openings 75, which respectively deliver the pressed pulp into a fall shaft 76, are arranged in an annular plate 74 of the lower part 4.

FIG. 2 shows a top view of the circular arc shape of the filling opening 41 between an outer end point of the connection part 40 and a point 77. The shape of the filling opening 41, which is rectangular as seen from the side, can be seen in FIGS. 1, 4A and 4B. A filling connection piece 78, which passes into a circular cross-sectional shape until its flange 79, extends tangentially outward from the filling opening 41. A tubular tamping worm 80, with which the wet pulp is fed under pressure in the direction of the arrow 81, is connected at the flange 79.

FIG. 3 shows how the screw part 39 and the connection part 40 are fastened to one another so as to be tight on the one hand, and to the annular wall 34 on the other hand by means of welding. Two of the web plates 35 are also seen above the screw part 39.

Figure 4A:
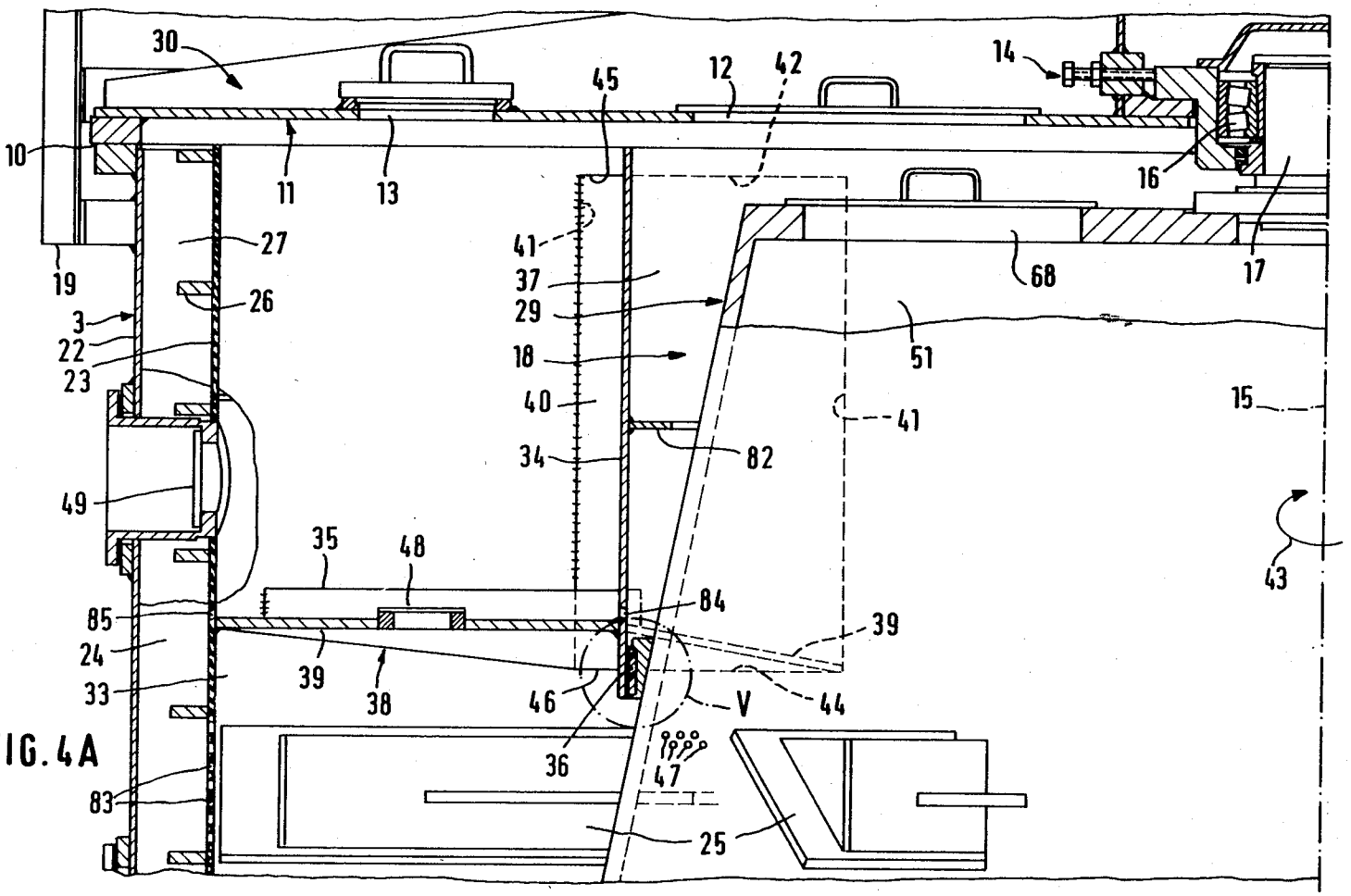
FIGS. 4A and 4B show the upper portion of FIG. 1 in an enlarged view.
Figure 4B:
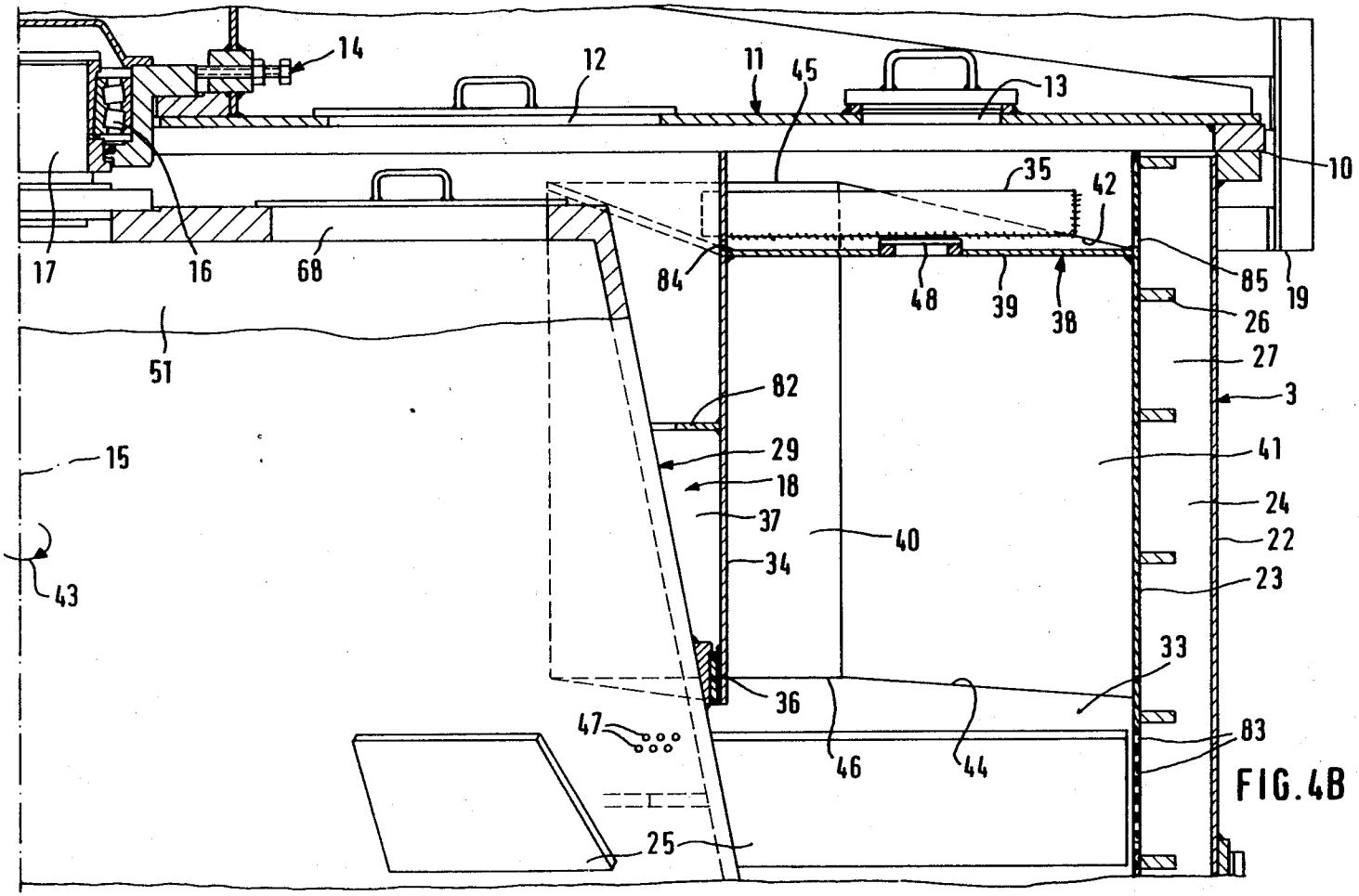
Figure 5:
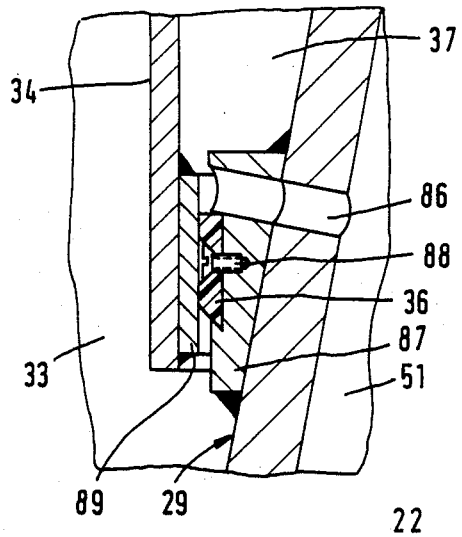
FIG. 5 shows the detail V in FIG. 4A in an enlarged view.

According to FIGS. 4A and 4B, a reinforcing ring 82, which extends radially inward, is welded on at the inside of the annular wall 34. The perforations 47 in the spindle body 29 start downward from the plane of the compressor blades 25. The screen casing 23 is also provided with holes 83 for the passage of pressed out fluid only downward from the compressor blades 25. Condensation forming above the screw part 39 can flow off through dewatering holes 84 in the annular wall 34 and dewatering holes 85 in the screen casing 23 which are respectively provided directly above the screw part 39. The condensation then flows into the wedge-shaped annular space 37 on the one hand and into the first annular space 24 on the other hand.

According to FIG. 5, additional dewatering holes 86 are located directly above the annular seal 36 in the spindle body 29 and as a continuation in a supporting ring 87 for the annular seal 36, which supporting ring 87 is welded on externally on the spindle body 29. The annular seal 36 consists of the plastics material known under the trademark Teflon and is embedded in the supporting ring 87 in a dovetail connection and fastened at the supporting ring 87 with countersunk screws 88. The annular seal 36 slides externally on a sliding ring 89 consisting of stainless steel which is welded into the annular wall 34 at the bottom and inside. Condensation which collects in the wedge-shaped annular space 37 can flow off without pressure through the dewatering holes 86 into the interior space 51.

Figure 6:
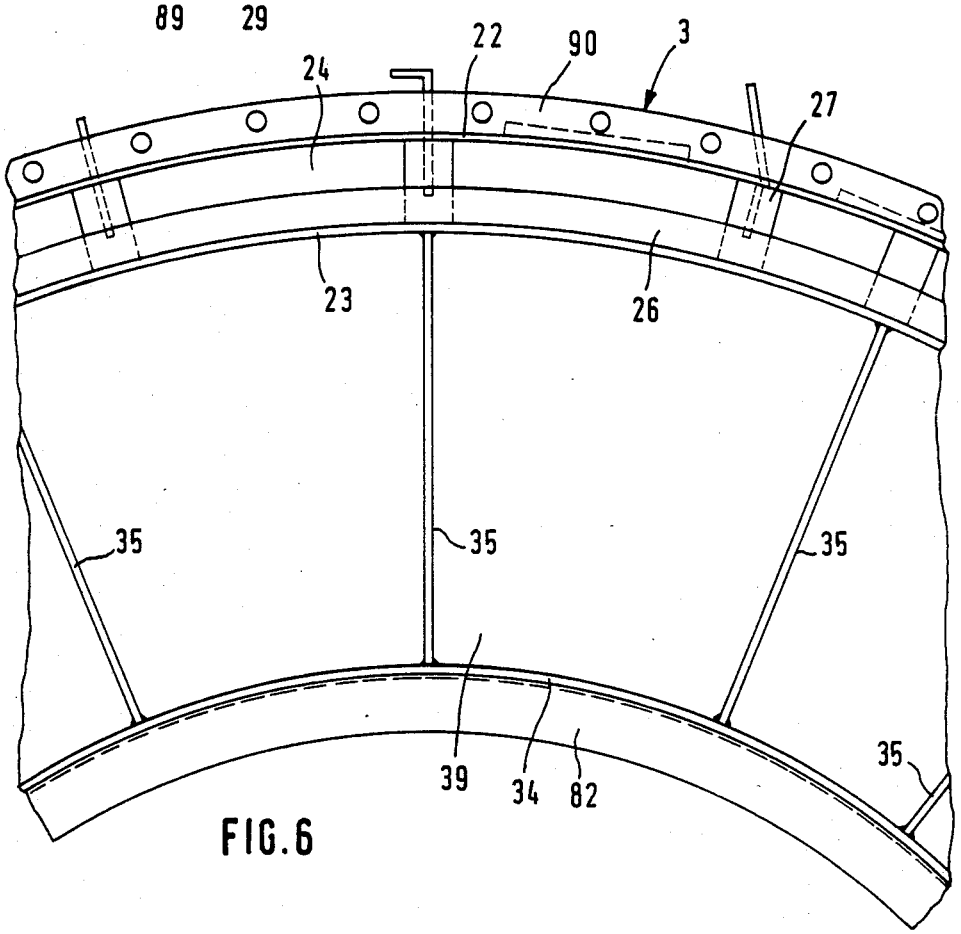
FIG. 6 shows a view according to line VI—VI in FIG. 1 in an enlarged view.

FIG. 6 shows details of the upper end of the upper part 3. An assembly flange 90 is welded on at the spray casing 22 at the top.

The embodiment form of the spindle press 1 shown in the aforementioned drawings operates as follows: when started, wet pulp is fed by means of the tamping worm 80, according to FIG. 2, and the filling connection piece 78 of the filling opening 41, through which the wet pulp falls downward into the second annular space 33. The retaining ring 70 (FIG. 1) prevents the pulp from falling directly into the annular space 72 through the outlet annular gap 71. As the press spindle 18 rotates, the second annular space 33 fills up increasingly with pulp material until the latter reaches the lower side of the helically constructed front wall 38. From this moment on, with the continued rotation of the press spindle 18, a mechanical compression of the wet pulp begins in the second annular space 33 above the compressor blades 25. The increasing and finally complete filling of the second annular space 33 with wet pulp can be followed through the observation openings 13 and the observation windows 48, which are aligned with the latter, as well as through the observation window 49. A considerable pressure increase of the wet pulp occurs above the compressor blades 25 by means of the screw part 39, supported by means of the conveying over of the tamping worm 80. This precompression is supported and increased by means of the compressor blades 25 before the pulp material, which is to be pressed and which is precompressed in this way, falls past the uppermost interruptors 28 in the effective area of the uppermost worm wings 69 and is increasingly compressed and dewatered by means of the latter and the second annular space 33, whose cross-sectional area narrows increasingly in a downward direction. The pressed out fluid passes outward into the first annular space 24 of the housing 2 and into the interior space 51 of the spindle body 29 and flows in both cases through the dewatering arrangement 32. The pressed pulp achieves an especially high amount of dry substance by means of this special pressure treatment and compression at the outlet annular gap 71. This is also a result of the fact that there are no holes for the passage of pressed out fluid in the area of the screen casing 23 located opposite the helically constructed front wall 38. This promotes the pressure increase in this precompression zone.

In all of the embodiment examples, identical parts are provided with the same reference numbers.

In FIG. 7, the spindle press comprises another filling opening 91 which is arranged so as to be diametrically opposite the filling opening 41. A tangential filling connection piece 92, which is fed with wet pulp through a tubular tamping worm 93 in the direction of the arrow 94, is connected to the additional filling opening 91. In FIG. 7, the screw part 39 extends only in the rotational direction 43 along 180° from the connection part 40 to an additional connection part 95 which is arranged so as to be diametrical to the connection part 40. Another screw part 96 extends in the rotational direction 43 from an end of the additional connection part 95 on the feed side to an end of the connection part 40 on the outlet side. In FIG. 7, the screw parts 39 and 96 form a "double thread" in a certain way. The upper part 3 can also be provided with more than the two filling openings 41 and 91. The helically constructed front wall 38 would then have a "multiple thread" in a corresponding manner. A more uniform distribution of the pressure increase along the circumference of the spindle press 1 can then be achieved by means of this "multiple thread" construction.

According to FIG. 8, the front wall 38, which can be constructed in the aforementioned manner as a "single thread" or "multiple thread" and is provided with a connection part, not shown in FIG. 8, per "thread", comprises a helical sliding ring 97 inside. The sliding ring 97 also extends along at least one connection part, not shown in FIG. 8, and has a radial sealing contact with a gasket 98 which is circular cylindrical at least externally. The gasket 98 is fastened with countersunk screws 99 at a part of the spindle body 29 on the feed side and extends in an axial direction along the entire "stroke" of the front wall 38. The gasket 98 can consist of the plastics material known under the trademark Teflon.

Figure 9:
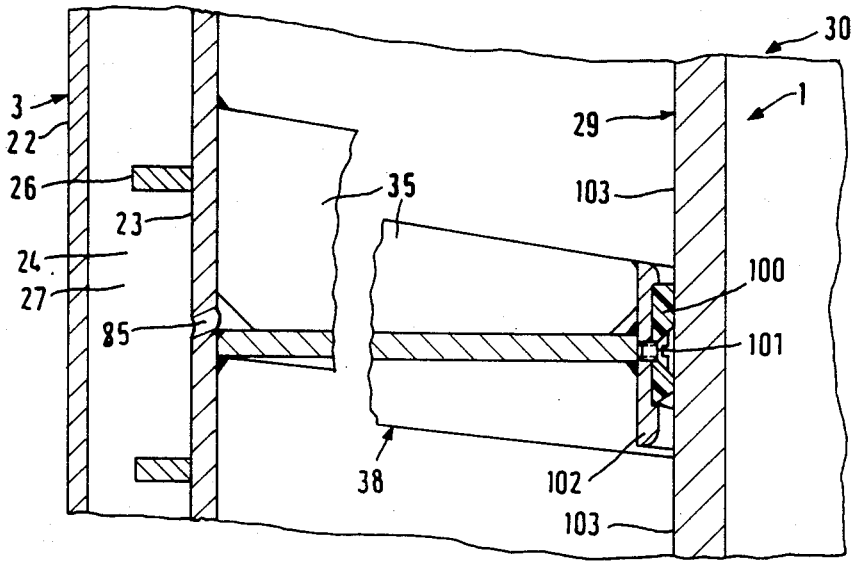

FIG. 9 shows another embodiment form of the spindle press 1 in which the front wall 38 carries a helical sealing strip 100 on the inside which can consist, for example, of the plastics material known under the trademark Teflon. The sealing strip 100 also extends along the inner edge of at least one connection part of the front wall 38, not shown in FIG. 9, and is fastened with countersunk screws 101 at a coaxial helical plate 102 of the front wall 38. The sealing strip 100 has a sealing contact with a circular cylindrical outer surface 103 at the end of the spindle body 29 on the feed side.

It will be understood that each of the elements described above, or two or more together, may also find a useful application in other types of constructions differing from the types described above.

While the invention has been illustrated and described as embodied in a spindle press for pressing fluid out of a material, such as sugar beet pulp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spindle press for pressing fluid out of a material, such as sugar beet pulp, comprising a housing having a feed side and an outlet side and including a spray casing and a screen casing arranged within said spray casing and forming a first annular space therebetween for guiding out fluid; a hollow spindle rotatably supported in said housing for pressing the material, said spindle being provided with perforations for fluid pressed from the material and enclosing an interior space for guiding out fluid, said spindle and said housing forming therebetween a second annular space into which the material to be pressed is fed at said feed side through filling means with at least one filling opening and from which the pressed material is discharged at said outlet side through an outlet annular gap, said spindle being provided with helically shaped ring worms which extend outwardly and substantially in contact with said screen casing; and a front wall for limiting said second annular space at said feed side, said front wall extending transversely to a longitudinal axis of said spindle and being sealed relative to the latter, said front wall being externally fastened to said housing in a tight manner, said front wall being helical in an opposite manner relative to said ring members, and said ring members having a commencement which lies behind an outlet side end of said front wall.

2. A spindle press as defined in claim 1, wherein said filling opening has an axial end on the feed side and an axial end on the outlet side, said front wall having a screw part extending in a direction of rotation of said spindle between said axial end on the feed side and said axial end on the outlet side, said screw part having a commencement on the feed side connected by means of a connection part in a tight manner with an end of said screw part on the outlet side, said connection part being sealed on an inside relative to said spindle and connected on an outside with said housing in a tight manner.

3. A spindle press as defined in claim 2, wherein said screw part and said connection part are connected in a tight manner on the outside with said screen casing of said housing.

4. A spindle press as defined in claim 1, wherein said filling means has a plurality of such filling openings, each of said filling openings having an axial end on the feed side and an axial end on the outlet side, said front wall having a plurality of screw parts each extending in a direction of rotation of said spindle between one of said axial ends on the feed side of one of said filling openings and said axial end on the outlet side of another one of said filling openings which, in said direction of rotation, is adjacent to said one of said filling openings, each of said screw parts having a commencement on the feed side connected by means of a connection part in a tight manner with an end on the outlet side of an adjacent one of said screw parts, each said connection part being sealed on an inside relative to said spindle and connected on an outside with said housing in a tight manner.

5. A spindle press as defined in claim 4, wherein each of said screw parts and each of said connection parts are connected in a tight manner on the outside with said screen casing of said housing.

6. A spindle press as defined in claim 1, wherein said screen casing of said housing does not have any holes for passage of pressed out fluid, at least in an axial area which is located opposite to said front wall.

7. A spindle press as defined in claim 1, wherein said screen casing has a plurality of dewatering holes on a feed side of said front wall for condensation, said dewatering holes being open into said first annular space.

8. A spindle press as defined in claim 1; and further comprising an annular wall for enclosing an end of said spindle on the feed side and sealed relative to said spindle on the outlet side, said front wall being fastened on an inside on said annular wall.

9. A spindle press as defined in claim 8; and further comprising means for sealing said annular wall relative to said spindle on the outlet side and including an annular seal.

10. A spindle press as defined in claim 1, wherein said front wall is sealed on an inside directly relative to said spindle.

11. A spindle press as defined in claim 1; and further comprising a gasket provided on a portion of said spindle on the feed side and being circular cylindrical at least on an outside, said front wall having a helical sliding ring provided on an inside and contacting said gasket so as to form a seal.

12. A spindle press as defined in claim 11, wherein said gasket and said portion of said spindle on the feed side are circular cylindrical.

13. A spindle press as defined in claim 1, wherein said spindle has a circular cylindrical outer surface, said front wall carrying a helical sealing strip provided on an inside and contacting said circular cylindrical outer surface so as to form a seal.

14. A spindle press as defined in claim 1, wherein said spindle has a spindle body provided with a plurality of compressor blades which are arranged in at least one transverse plane adjacent to an end of said front wall on the feed side and prior to commencement of said wing members, said compressor blades extending outwardly substantially in contact with said screen casing.

15. A spindle press as defined in claim 1, wherein said spindle has a plurality of perforations which are provided for passage for pressed out fluid and arranged only after the outlet side end of said front wall in direction of said outlet side.

16. A spindle press as defined in claim 15, wherein said screen casing has a plurality of holes, said spindle having a plurality of compressor blades which are arranged in at least one transverse plane adjacent to an end of said front wall on the feed side and prior to commencement of said wing members, said compressor blades extending outwardly substantially in contact with said screen casing, said holes of said screen casing and said perforations of said spindle beginning in the area of said compressor blades.

17. A spindle press as defined in claim 1, wherein said filling means comprises at least one tamping worm.

18. A spindle press as defined in claim 17, wherein each of said tamping worms is connected to a respective one of said filling openings tangentially relative to said second annular space.

* * * * *